US007023295B2

(12) United States Patent
Ko et al.

(10) Patent No.: US 7,023,295 B2
(45) Date of Patent: Apr. 4, 2006

(54) TRANSMISSION LINE HAVING PHOTONIC BAND GAP COPLANAR WAVEGUIDE STRUCTURE AND METHOD FOR FABRICATING POWER DIVIDER USING THE SAME

(75) Inventors: Young-Joon Ko, Seoul (KR); Jae-Yeong Park, Seoul (KR)

(73) Assignee: LG Electronics Inc., Seoul (KR)

( * ) Notice: Subject to any disclaimer, the term of this patent is extended or adjusted under 35 U.S.C. 154(b) by 43 days.

(21) Appl. No.: 10/776,512

(22) Filed: Feb. 12, 2004

(65) Prior Publication Data

US 2004/0160293 A1 Aug. 19, 2004

(30) Foreign Application Priority Data

Feb. 13, 2003 (KR) ..... 10-2003-0009112

(51) Int. Cl.
*H01P 5/12* (2006.01)
*H01P 3/08* (2006.01)

(52) U.S. Cl. ..... 333/128; 333/136; 333/137; 333/127; 333/238

(58) Field of Classification Search ..... 333/100, 333/109, 111, 115, 116, 124, 125, 127, 128, 333/136, 137, 238

See application file for complete search history.

(56) References Cited

U.S. PATENT DOCUMENTS 5,652,557 A * 7/1997 Ishikawa ..... 333/243
2002/0047755 A1 4/2002 Sugawara et al. ..... 333/127

OTHER PUBLICATIONS

Fu Y-Q et al. : "A Novel PBG Coplanar Waveguide", IEEE Microwave and Wireless Components Letters, IEEE Service Center, Piscataway, NJ, US, vol. 11, No. 11, Nov. 2001, pp. 447-449, XP001093342 ISSN: 1531-1309.
Lim J-S et al. : "A 4:1 Unequal Wilkinson Power Divider", IEEE Microwave and Wireless Components Letters, IEEE Service Center, Piscataway, NJ, US., vol. 11, No. 3, Mar. 2001, pp. 124-126, XP001058529 ISSN: 1531-1309.
Jaisson D: "An Asymmetrical Coplanar Waveguide for Use With A Coplanar Wilkinson Power Divider", Microwave Journal, Horizon House, Dedham, US, vol. 38, No. 11, Nov. 1, 1995, pp. 68, 70, 73-74, XP000547927 ISSN: 0192-6225.

(Continued)

*Primary Examiner*—Barbara Summons
(74) *Attorney, Agent, or Firm*—Birch, Stewart, Kolasch & Birch,LLP

(57) ABSTRACT

A photonic band gap coplanar waveguide transmission line and a method for fabricating a power divider using the same capable of increasing a characteristic impedance, increasing a signal line width of the transmission line and providing high power, includes: a ground conductive layer formed on a substrate; linear grooves formed on the ground conductive layer; a signal line formed between linear grooves; rectangular grooves formed close to the signal line, and formed on the ground conductive layer; and slots formed at the rectangular grooves respectively, and connecting the rectangular groove and the linear groove.

8 Claims, 7 Drawing Sheets

OTHER PUBLICATIONS

Ahn H R et al. : "General Design Equations of Three-Port Unequal Power-Dividers Terminated By Arbitrary Impedances", Microwave Symposium Digest, 2000 IEEE MTT-S International, Boston, MA, USA Jun. 11-16, 2000, Piscataway, NJ, USA, IEEE, US, Jun. 11, 2000, pp. 1137-1140, XP010507537 ISBN: 0-7803-5687-X.

Ko Y-J et al. : "Fully Integrated Unequal Wilkinson Power Divider with EBG CPW", IEEE Microwave and Wireless Components Letters, IEEE Service Center, Piscataway, NJ, US, vol. 13, No. 7, Jul. 2003, pp. 276-278, XP001170025 ISSN: 1531-1309.

* cited by examiner

TRANSMISSION LINE HAVING PHOTONIC BAND GAP COPLANAR WAVEGUIDE STRUCTURE AND METHOD FOR FABRICATING POWER DIVIDER USING THE SAME

This Nonprovisional application claims priority under 35 U.S.C. § 119(a) on patent application No(s). 10-2003-0009112 filed in KOREA on Feb. 13, 2003, the entire contents of which are hereby incorporated by reference.

BACKGROUND OF THE INVENTION

1. Field of the Invention

The present invention relates to a transmission line, and particularly, to a transmission line having a photonic band gap (PBG) coplanar waveguide (CPW) structure and a method for fabricating a power divider using the same.

2. Description of the Prior Art

In general, most important factors in designing a transmission line are a correct characteristic value and a maximum received power of a transmission line. The maximum received power means a limit of power a transmission line can endure. That is, even though a transmission line has an accurate characteristic value, if power higher than the maximum received power is applied to such a transmission line, the transmission line itself is broken.

FIG. 1 illustrates a transmission line having a general coplanar waveguide (CPW), As shown therein, a signal applied to an input terminal 11 of a transmission line 10 generates an electric field and a magnetic field through an interval 14 between a signal line 13 and a ground-conductive layer 16 to be transmitted to an output terminal 12 of the transmission line 10. At this time, a characteristic impedance value of the transmission line 10 is determined by a width of the signal line 13, a distance 14 between the signal line 13 and a ground-conductive layer 16, a thickness of a substrate 17 and a dielectric constant of the substrate 17.

In addition, in case that a dielectric constant of the substrate 17 is high, a width of the signal line 13 is remarkably narrowed. That is, if power is applied to the signal line 14 having a small width (e.g., 2.5 μm), the signal line 13 may be short-circuited by heat. For example, on the assumption that a distance between ground-conductive layers 16 is 240 μm, the width of the signal line should be smaller than 2.5 μm in order to implement a CPW having a characteristic impedance of 132 ohms or more on a GaAs substrate having a thickness of 625 μm and a dielectric constant of 12.9. But, it is very difficult to implement a signal line having a width of 2.5 μm or less. Accordingly, a CPW having a signal line a width of which is wide and a high characteristic impedance is needed.

Recently, a CPW structure to which a Photonic Band Gap (PBG) is applied has be proposed. The PBG CPW structure is used as a band-stop filter having a reduction characteristic for a specific frequency band.

The PBG suppresses an advance of an electromagnetic wave and changes an impedance and a phase of a transmitted signal. The PBG structure is mainly applied to an antenna having a microstrip form, a resonator, a filter or the like.

However, the PBG CPW structure according to the conventional art cannot obtain a high characteristic impedance. That is, in the PBG CPW structure in accordance with the conventional art, a width of a signal line should be narrow in order to obtain a high impedance. But if the width of the signal line is narrow, it is difficult to apply the PBG CPW structure to a passive circuit of a micro wave band or a millimeter wave band.

Accordingly, it is difficult to apply a transmission line having the PBG CPW structure or having a general. CPW structure to an unequal Wilkinson power divider requiring a high impedance characteristic. In addition, since the transmission line having the PBG CPW structure or having a general CPW structure cannot have a high characteristic impedance, it is also difficult to apply such a transmission line to an antenna or a filter requiring a high characteristic impedance.

As so far described, in the coplanar wave guide (CPW) in accordance with the present invention, if a characteristic impedance is increased, a width of a signal line should be remarkably reduced. In addition, if a characteristic impedance is increased in a high frequency band, a width of the signal line should be extremely reduced. For this reason it is difficult to implement a transmission line having a high impedance.

In addition, since a power divider in accordance with the conventional art dividea high power in a high frequency band and requires a high characteristic impedance, it is difficult to apply the transmission line having the PBG CPW structure in accordance with the conventional art to the power divider. That is, a signal line having a narrow width can be easily broken and is hard to fabricate.

A transmission line in accordance with another conventional art is disclosed in U.S. Pat. No. 6,518,864 registered on 11$^{st}$ Feb., 2003.

SUMMARY OF THE INVENTION

Therefore, an object of the present invention is to provide a transmission line having a Photonic Band Gap (PBG) Coplanar Waveguide (CPW) structure and a method for fabricating a power divider using the same capable of increasing a characteristic impedance and increasing a width of a signal line of a transmission line.

Another object of the present invention is to provide a PBG CPW transmission line and a method for fabricating a power divider using the same capable of providing high power.

To achieve these and other advantages and in accordance with the purpose of the present invention, as embodied and broadly described herein, there is provided a transmission line having a photonic band gap (PBG) coplanar waveguide (CPW) structure comprising: a ground conductive layer formed on a substrate; linear grooves formed on the ground conductive layer; a signal line formed between the linear grooves; rectangular grooves formed close to the signal line, and formed on the ground conductive layer; and slots formed at the rectangular grooves respectively, and connecting the rectangular grooves and the linear groove.

To achieve these and other advantages and in accordance with the purpose of the present invention, as embodied and broadly described herein, there is provided a transmission line having a photonic band gap (PBG) coplanar waveguide (CPW) structure comprising: a ground conductive layer formed on a substrate; linear grooves formed on the ground conductive layer; a signal line formed between the linear grooves; rectangular grooves formed on the ground conductive layer; and slots respectively formed at edges of the rectangular grooves, and connected to the linear grooves opposite to the rectangular grooves, wherein the slots are symmetric to each other and placed close to each other.

To achieve these and other advantages and in accordance with the purpose of the present invention, as embodied and broadly described herein, there is provided a method for fabricating a power divider comprising: forming a resistance layer on a part of a substrate having a first conductive layer; forming a seed layer on a part of the resistant layer and on both side surfaces of the resistance layer; forming a second conductive layer on the seed layer; forming rectangular grooves on the first conductive layer; and forming a slot at the rectangular groove, wherein the first conductive layer is formed close to the second conductive layer, and the slots are symmetric to each other and placed close to each other.

To achieve these and other advantages and in accordance with the purpose of the present invention, as embodied and broadly described herein, there is provided a power divider comprising: a substrate; a first conductive layer formed on a part of the substrate; a resistance layer formed on a part of the substrate; a seed layer formed on a part of the resistance layer and on both side surfaces of the resistance layer; a second conductive layer formed on the seed layer; rectangular grooves formed on the first conductive layer; and slots connected to the rectangular grooves, wherein, the first conductive layer is formed close to the second conductive layer, and the slots are symmetric to each other and placed close to each other.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Hereinafter, there will be described with reference to FIGS. 2~11, preferred embodiments of a transmission line having a photonic band gap (PBG) coplanar waveguide (CPW) structure and a method for fabricating a power divider using the same capable of increasing a characteristic impedance, increasing a width of a signal line of a transmission line and providing high power.

Figure 1:
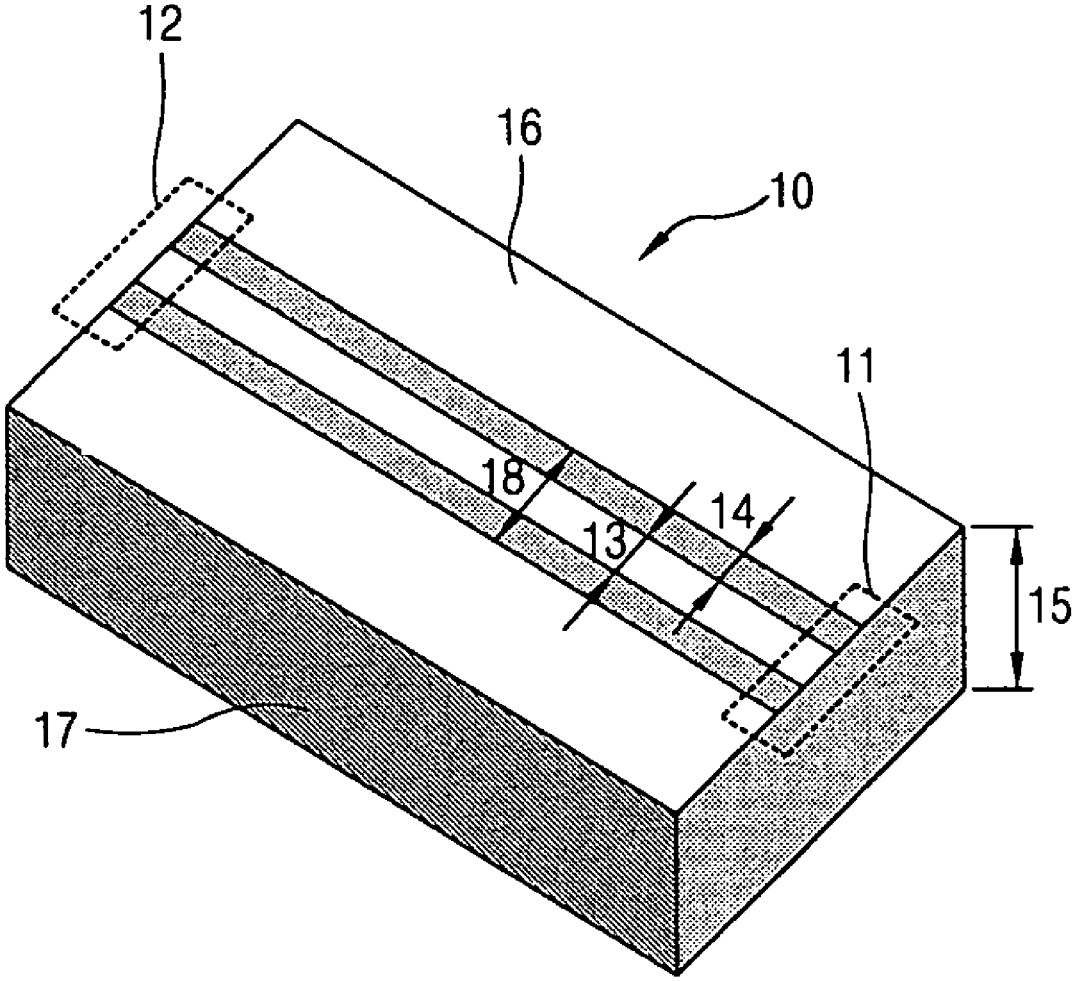
FIG. 1 PRIOR ART
FIG. 1 shows a transmission line having a general Coplanar Waveguide (CPW) structure.
Figure 2:
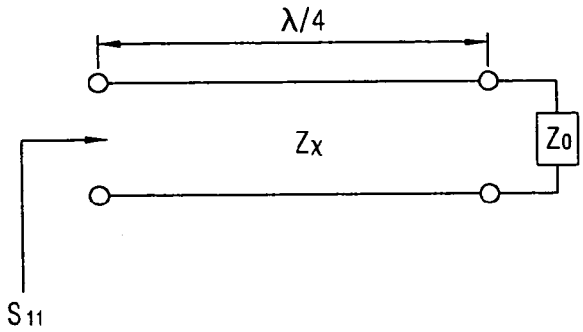
FIG. 2 is a view showing a general transmission line a load terminal of which is short-circuited for describing the present invention.

FIG. 2 is a view showing a general transmission line a load terminal of which is short-circuited, for describing the present invention.

As shown therein, when a load terminal (load impedance (Zo) is short-circuited, a characteristic impedance of the transmission line becomes Zx. Herein, $S_{11}$ of an input terminal of the transmission line is a reflection coefficient.

When a length of the transmission line is $\lambda/4$, a characteristic impedance (Zx) of the transmission line corresponds to a maximum reflection coefficient value, and can be obtained by a width of a signal line of the transmission line. In addition, the characteristic impedance (Zx) of the transmission line can be expressed with a reflection coefficient ($S_{11}$) of an input terminal of the transmission line by expression 1 below. A unit of the reflection coefficient is dB.

$$Zx = Zo * \sqrt{\frac{1 + 10^{0.05 * S_{11}}}{1 - 10^{0.05 * S_{11}}}} - [Ohm] \qquad \text{expression 1}$$

Herein, Zo is a load impedance.

For example, a width of the signal line of the transmission line is 2.5 μm, and a characteristic impedance of a transmission line having a CPW structure in which a distance between a signal line and a ground conductive layer is 150 μm, is 132 ohms, and by applying the characteristic impedance of 132 ohms to the expression 1, the reflection coefficient of −2.4 dB is obtained. The transmission line having 132 ohms is used in designing and fabricating an 1:3 unequal Wilkinson power divider. But, since it is very difficult to produce a line width of 2.5 μm, a transmission line having a line width which is easy to produce (implement) and having a high impedance, is required.

Accordingly, in the present invention, a width of a signal line is fixed to a predetermined size (e.g., 10 μm) so as to be easily implemented, and electric parameters are changed in order to increase a characteristic impedance of the transmission line. In an embodiment of the present invention, an improved PBG CPW structure having a signal line width of 10 μm is used. That is, even though a width of the signal line is fixed to 10 μm, a characteristic impedance still becomes 132 ohms. Herein, a width of the signal line can be varied, and also the characteristic impedance can be varied according to an object of a design.

Hereinafter, there will now be described a transmission line structure to which a PBG CPW structure wherein a width of a signal line of a transmission line is predetermined (fixed) to an easily-implementable size, and which can increase a characteristic impedance, is applied.

Figure 3:
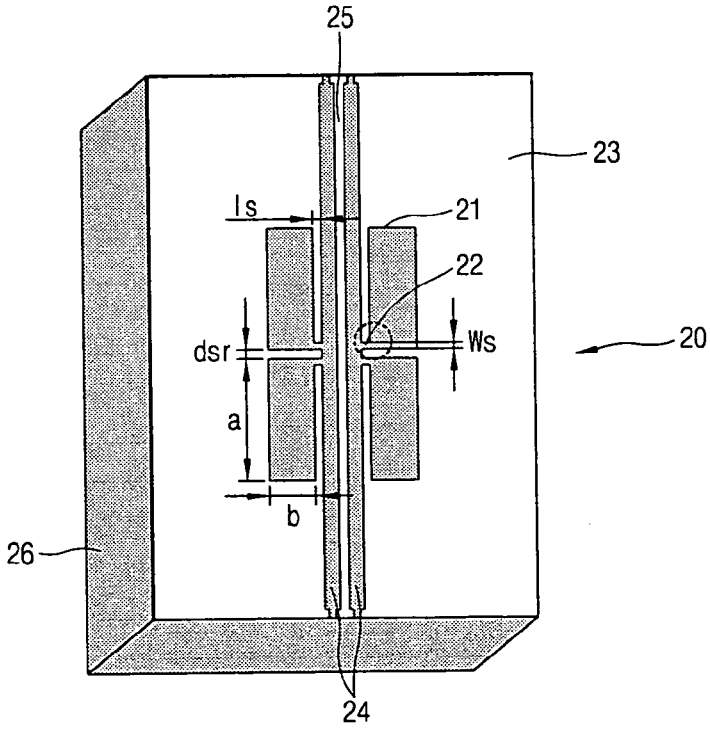
FIG. 3 is a view showing a first embodiment of a transmission line having a PBG CPW structure in accordance with the present invention.

FIG. 3 is a view showing a first embodiment of a transmission line having a PBG CPW structure in accordance with the present invention.

As shown therein, the transmission line 20 having a PBG CPW structure in accordance with the present invention includes: a ground conductive layer 23 (a first conductive layer) formed on a dielectric substrate; linear grooves 24 formed on the ground conductive layer 23 so that a surface of the dielectric substrate is exposed; a signal line conductive layer 25 (a second conductive layer) formed between linear grooves 24; rectangular grooves 21 formed on the ground conductive layer 23; and slots 22 formed at edges of the rectangular grooves 21 respectively, and connected to the linear groove 24 opposite to the rectangular groove 21. Herein, the slots are symmetric to each other and placed closely. Herein, a width of a signal line of the transmission line is 10 μm. In addition, on the ground conductive layer 23, four rectangular grooves 21 symmetric to each other are positioned, and slots 22 respectively connected to the four rectangular grooves 22 are positioned. Herein, each pair of rectangular grooves 21 is opposite to one linear groove 24, and one slot is placed at an edge of the rectangular groove 21 opposite to the linear groove 24. The four slots are symmetric to each other, and formed close.

A signal passing through the signal line 25 is excited by the narrow slots 22 connected to the four symmetric rectangular grooves 21, and a characteristic impedance of the transmission line is determined by an electrical parameter of the improved PBG structure together with a width of the signal line.

The electrical parameters are an area (a×b) of rectangular grooves 21, a width (Ws) and a length (Is) of the slot 22 and a distance (dsr) between the slots 22. Among the electrical parameters, main electrical parameter for increasing a characteristic impedance of a transmission line having a PBG CPW structure are a width (Ws) of a slot 22 and a distance (dsr) between slots 22. For example, as the width (Ws) of the slot 22 and the distance (dsr) between slots 22 decrease, a characteristic impedance value of the transmission line increases. On the other hand, as the width (Ws) of the slot and the distance (dsr) between slots 22 increase, a characteristic impedance value of the transmission line decreases. That is, an inductance component is increased in a state that a width (e.g., 10 μm) of the signal line 25 has been widened, to increase a characteristic impedance. Herein, a distance (dsr) between the slots 22 means a distance between slots connected to a pair of rectangular grooves 21 opposite to one linear groove 24.

Figure 4:
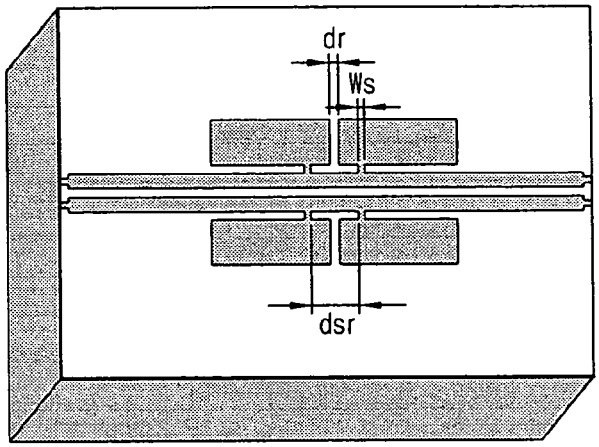
FIG. 4 is a view showing a second embodiment of a transmission line having a PBG CPW structure in accordance with the present invention.

FIG. 4 is a view showing a second embodiment of a transmission line having a PBG CPW structure in accordance with the present invention.

As shown in FIG. 4, a width (Ws) of the slot 22 and a distance (dsr) between slots 22 can be varied according to a characteristic impedance value a user demands. For example, when a characteristic impedance value a user demands is small, a width (Ws) of the slot and a distance (dsr) between slots 22 are increased so that the characteristic impedance value of the transmission line can be decreased. On the other hand, when a characteristic impedance value a user demands is large, a width (Ws) of the slot 22 and a distance (dsr) between slots 22 are reduced so that the characteristic impedance value of the transmission line can be increased.

Accordingly, as shown in FIGS. 3 and 4, a width (Ws) of the slot 22 and a distance (dsr) between slots 22 are variously designed according to a characteristic impedance value a user demands.

Figure 5:
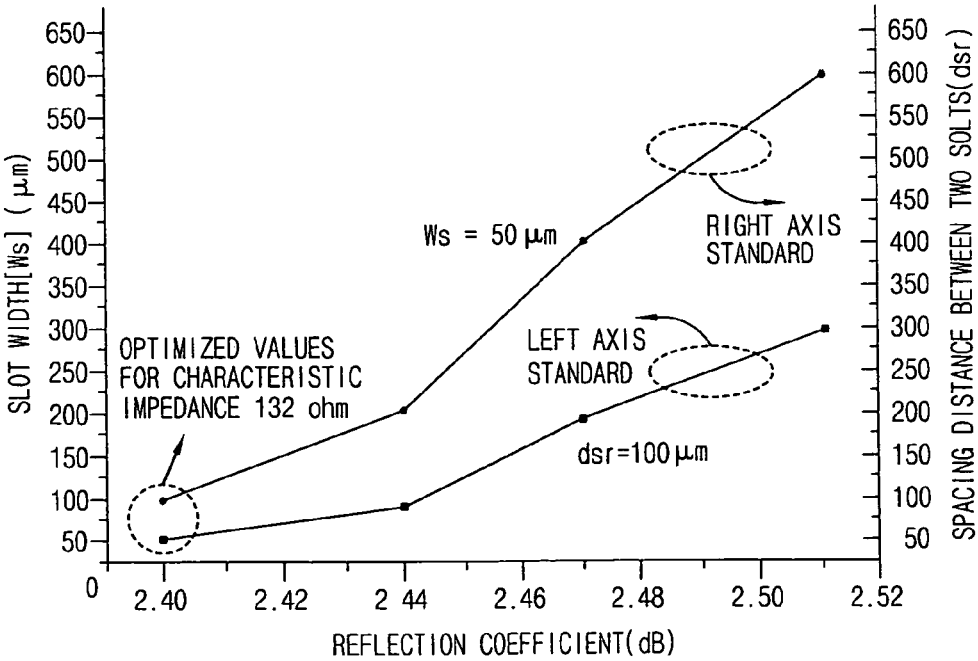
FIG. 5 is a graph showing a reflection coefficient of a transmission line input terminal in relation to a width (Ws) of a slot of a transmission line having a PBG CPW structure in accordance with the present invention and a distant (dsr) between slots.

FIG. 5 is a graph showing a reflection coefficient of an input terminal of a transmission line in relation to a width (Ws) of a slot and a distance (dsr) between slots of a transmission line having a PBG CPW structure.

As shown therein, a reflection coefficient of an input terminal of the transmission line is indicated on an x-axis, a distance (dsr) between slots of rectangular grooves 21 each pair of which is opposite to one linear groove 24 is indicated on a y-axis on the right, and a width (Ws) of each slot is indicated on a y-axis on the left. As shown therein, as the width (Ws) of the slot 22 and the distance (dsr) between slots decrease, a reflection coefficient increases (due to −dB). Herein, if the reflection coefficient increases, a characteristic impedance of the transmission line increases too. For example, when a width of the signal line 25 is 10 μm or more, a slot width (Ws) of the transmission line is 50 μm, a distance (dsr) between slots is 100 μm, a width (a) of a rectangular groove 21 is 1400 μm, and its length (b) is 500 μm, a value of the reflection coefficient becomes −2.4 dB. When the value of the reflection coefficient is −2.4 dB, a characteristic impedance of the transmission line becomes 132 ohms. That is, a slot width (Ws) optimized to obtain a high characteristic impedance (132 ohms) is 50 μm, and a distance (dsr) between slots is 100 μm. In addition, a characteristic impedance value of the transmission line can be changed by changing a slot width (Ws) of the transmission line and a distance (dsr) between slots, regardless of a width of the signal line 25.

Accordingly, even though a width of a signal line 25 of the transmission line is wide, a characteristic impedance value can be increased by reducing only a slot width (Ws) and a distance (dsr) between slots 22.

Hereinafter, there will now be described with reference to FIG. 6, a characteristic impedance of the transmission line when an improved PBG CPW structure in accordance with the present invention is not applied to a transmission line.

Figure 6:
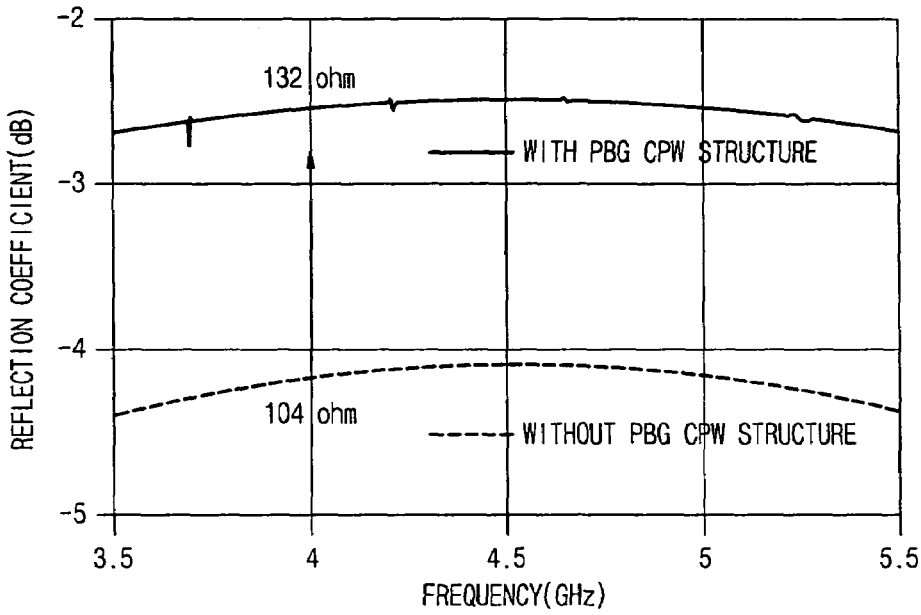
FIG. 6 is a view comparatively showing a case that an improved PBG CPW structure in accordance with the present invention is not applied to a transmission line and a case that the improved PBG CPW structure is applied thereto.

FIG. 6 is a view comparatively showing a case that an improved PBG CPW structure in accordance with the present invention is not applied to a transmission line and a case that the structure is applied thereto.

As shown therein, a characteristic impedance is 104 ohms when the improved PBG CPW structure is not included in the transmission line, and it is 132 ohms when the improved PBG CPW structure is included therein. Accordingly, a reflection coefficient becomes below −4 dB in case that the improved PBG structure is not included in the transmission line. That is, by the present invention, a transmission line to which a PBG CPW structure having a wide line width and a high characteristic impedance is applied can be implemented.

Hereinafter, a construction of a power divider to which a PBG CPW transmission line having the wide line width and the high characteristic impedance is applied will now be described with reference to FIG. 7.

Figure 7:
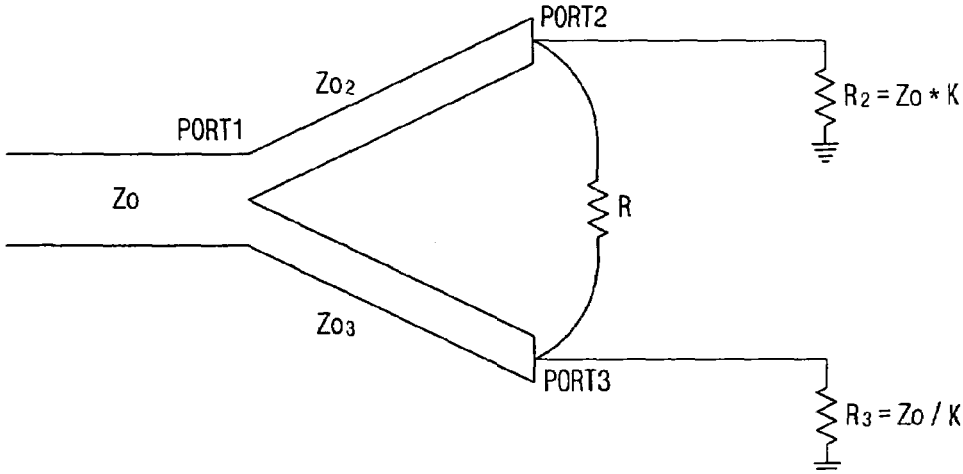
FIG. 7 is a view showing a circuit of an unequal Wilkinson power divider for describing a power divider in accordance with the present invention.

FIG. 7 is a view showing a circuit of a general unequal Wilkinson power divider for describing a power divider in accordance with the present invention.

As shown therein, input power made incidence to a port 1 is divided to a port 2 and a port 3 respectively, and a ratio of the divided power is defined as $$\sqrt{\frac{PORT3POWER}{PORT2POWER}} = k.$$

In order to obtain characteristic impedances ($Zo_2$, $Zo_3$) of the transmission line, expression 2 below is used.

$$Zo_2 = k^2 * Zo_3,\ Zo_3 = Zo * \sqrt{\frac{(1+k^2)}{k^3}},\ R = Zo * \left(\frac{k+1}{k}\right) \quad \text{expression 2}$$

Herein, the characteristic impedances ($Zo_2$, $Zo_3$) mean a characteristic impedance for dividing power to each port 2 and 3. The R is resistance for increasing an isolation between output ports (port 2 and port 3). Herein, the calculated characteristic impedances ($Zo_2$, $Zo_3$) are 44 ohms and 132 ohms respectively, and the resistance (R) for increasing an isolation is 115 ohms, Hereinafter, a structure of a 1:3 unequal Wilkinson power divider to which a transmission line having an improved PBG CPW structure in accordance with the present invention is applied, will now be described with reference to FIG. 8.

Figure 8:
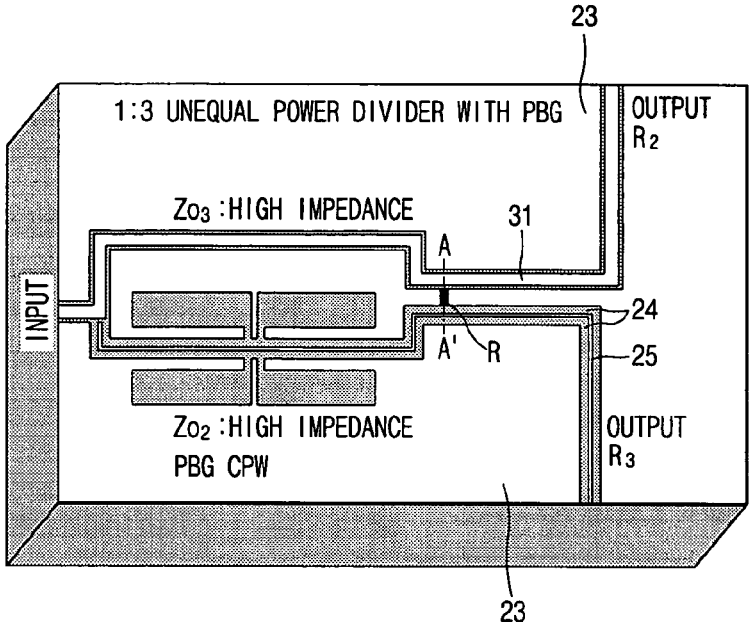
FIG. 8 is a view showing a structure of an unequal Wilkinson power divider to which a PBG CPW transmission line in accordance with the present invention is applied.

FIG. 8 is a view of an unequal Wilkinson power divider to which a PBG CPW transmission line in accordance with the present invention is applied. A GaAs substrata having a dielectric constant of 12.9 and a thickness of 625 μm is used in the unequal Wilkinson power divider. In addition, in order to obtain a characteristic impedance of 44 ohms, preferably, a width of a signal line 31 is 136 μm, and a distance between the signal line 31 and a ground conductive layer 23 is 52 μm. In addition, in order to obtain a characteristic impedance of 132 ohms, preferably, a width of a signal line is 10 μm, and a distance between the signal line 25 and a ground conductive layer 23 is 115 μm.

In order to easily measure the divider by using a network analyzer, resistance, R2 and R3 of a termination is replaced with λ/4 transformer and a load impedance of 50 ohms. To measure an 1:3 unequal Wilkinson power divider having the improved PBG CPW through an EM (electromagnetic) simulator, in a 3.5 GHz ~5.5 GHz frequency band, insertion loss of the power divider is −0.7 dB, return loss is −15 dB and an isolation between two output ports (port 2 and port 3) is −20 dB. And a power ratio between port 2 and port 3 is 1:3.

Table 1 below shows a design parameter of an 1:3 unequal Wilkinson power divider having the improved PBG CPW.

TABLE 1

| | Zo | Zo2 | Zo3 | R2 | R3 |
|---|---|---|---|---|---|
| characteristic impedance & termination resistance (ohm) | 50 | 132 | 44 | 87 | 29 |
| signal line width (μm) | 110 | 10 + PBG CPW | 136 | 166 | 58 |

Hereinafter, a method for fabricating an 1:3 unequal power divider in accordance with the present invention will now be described with reference to FIGS. 9A~9E. Herein, FIGS. 9A~9E are sectional views of A—A' of a power divider of FIG. 8.

FIGS. 9A~9E are sectional views sequentially showing a method for fabricating an 1:3 unequal Wilkinson power divider in accordance with the present invention. For example, a method for fabricating an 1:3 unequal Wilkinson power divider in accordance with the present invention includes: forming a resistance layer (R) on a part of a substrate having a first conductive layer 23; forming a seed layer 27 on a part of the resistance layer (R) and on both side surfaces of the resistance layer (R); forming a second conductive layer 25, 31 on the seed layer 27; forming rectangular grooves 21 on the first conductive layer 23; and forming a slot 22 at the rectangular groove 21. Herein, the first conductive layer 23 is formed close to the second conductive layer 25, 31, and the slots 22 are symmetric to each other and placed close to each other.

Hereinafter, a method for fabricating an 1:3 unequal Wilkinson power divider in accordance with the present invention will now be sequentially described with reference to FIGS. 9A~9E.

Figure 9A:
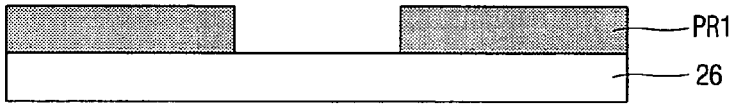
FIG. 9A~9E are sectional views sequentially showing a method for fabricating a 1:3 unequal Wilkinson power divider in accordance with the present invention.

First, as shown in FIG. 9A, a first photoresist pattern (PR1) is formed on the substrate 26 so that a part of surface of a GaAs substrate 26 having 625 μm is exposed. Herein, the first photoresist pattern (PR1) is to form a resistance layer (R).

Figure 9B:
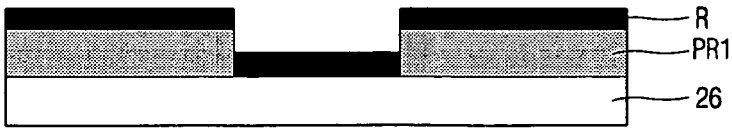

As shown in FIG. 9B, a Nichrome (R), a resistance layer is deposited on the first photoresist pattern (PR1) and the exposed substrate.

Figure 9C:
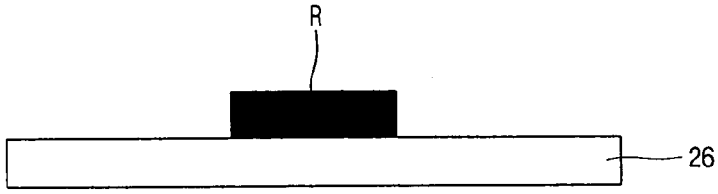

As shown in FIG. 9C, when the Nichrome (R) deposited on the first photoresist pattern (PR1) and the first photoresist patter (PR1) are removed, Nichrome remains on the exposed substrate, to form a resistance layer.

Figure 9D:
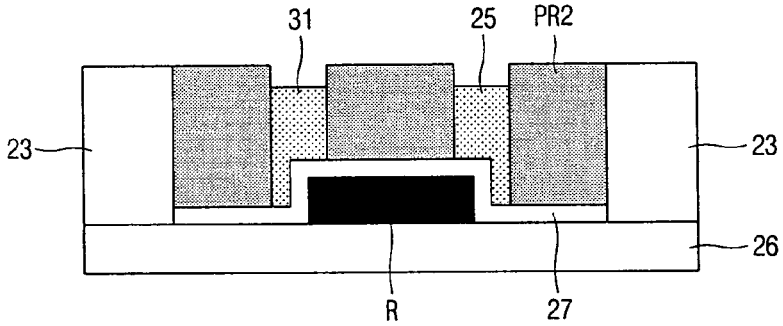

As shown in FIG. 9D, a seed layer 27 made of Au/Ti is formed on the exposed substrate and an entire surface of the Nichrome, and a second photoresist pattern (PR2) is formed on a part of the seed layer 27. Then, a signal line 25, 31 made of Au is formed on the exposed seed layer 27. Herein, the ground conductive layer 23 is formed on the substrate 26, and preferably, after a part of the ground conductive layer 23 has been removed, the resistance layer (R), the seed layer 27, and the signal line 25, 31 are formed on the removed portion.

Figure 9E:
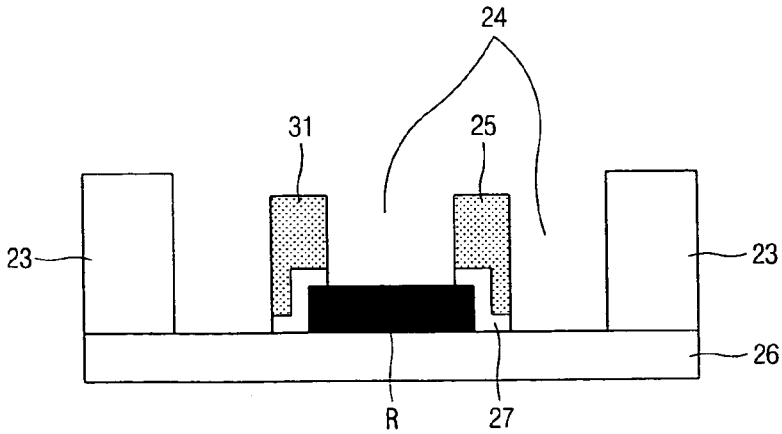

As shown in FIG. 9E, the second photoresist pattern (PR2) is removed, and the seed layer 27 exposed by removing the second photoresist pattern (PR2) is removed by wet-etching.

Herein, a thickness of Au (signal line 25, 31) implemented through the method for fabricating the power divider is about 3 μm.

Figure 10:
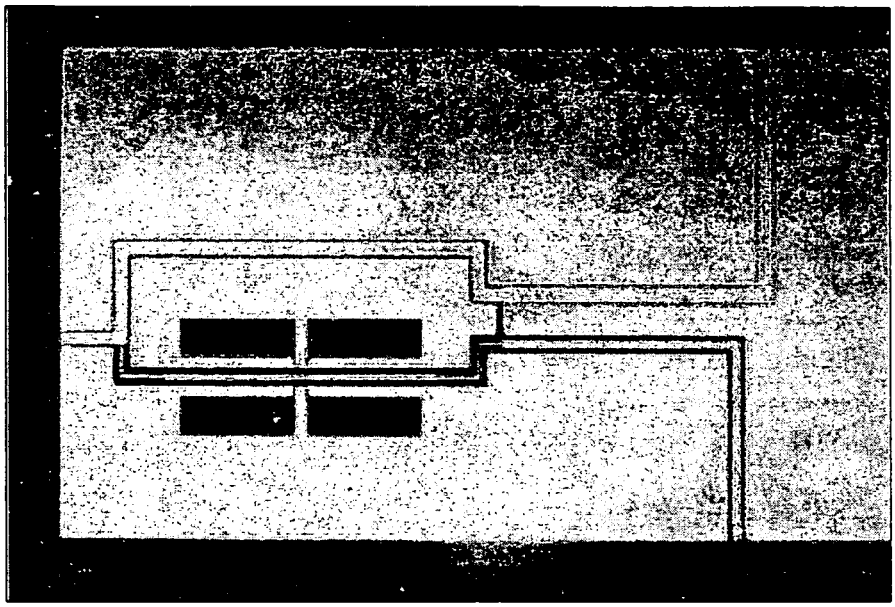
FIG. 10 is a view showing an actual 1:3 unequal Wilkinson power divider fabricated through a method for fabricating a power divider of FIGS. 9A~9E.

FIG. 10 is a view showing an actual 1:3 unequal Wilkinson power divider fabricated through a method for fabricating a power divider of FIGS. 9A~9E.

Hereinafter, a result of measuring performance of an actually-fabricated power divider will now be described with reference to FIG. 11.

Figure 11:
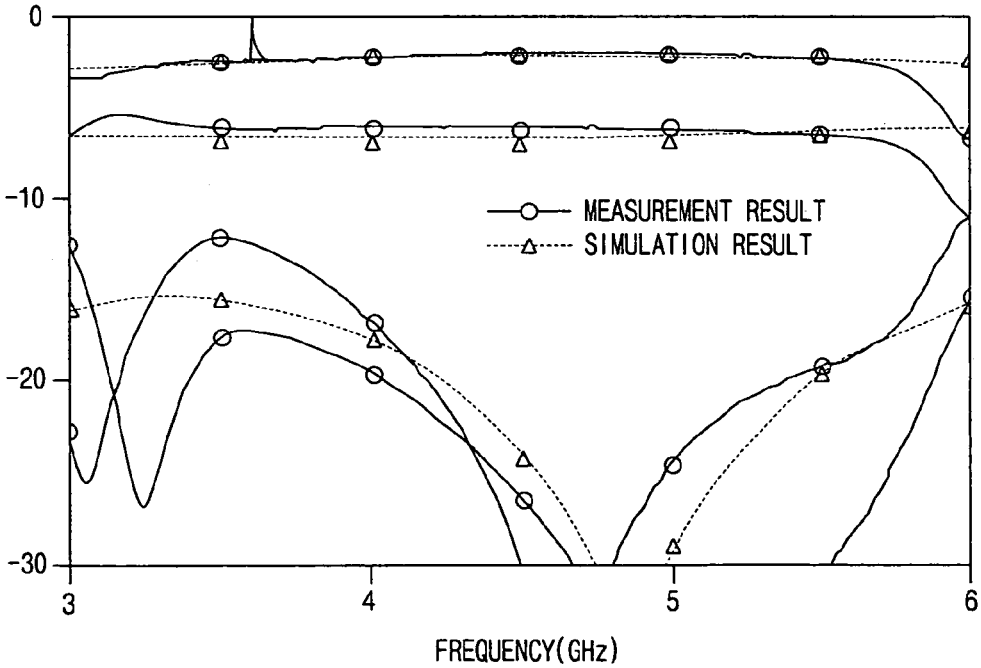
FIG. 11 is a graph showing a simulation result and an actual measurement result of an unequal Wilkinson power divider to which a PBG CPW structure in accordance with the present invention is applied.

FIG. 11 is a graph showing a simulation result and an actual measurement result of an unequal Wilkinson power divider to which a PBG CPW structure in accordance with the present invention is applied.

As shown therein, it can be known that a result of predicting performance of the fabricated power divider through simulation and a result of measuring performance thereof are about the same.

In order to measure performance of fabricated power divider, HP 8510C Network analyzer of Hewlett-Packard company is used, and a result of measuring performance of the fabricated power divider is shown in Table 2 below.

TABLE 2

| | Simulation result | Measurement result |
|---|---|---|
| Insertion loss | −0.7 dB | −0.7 dB |
| Return loss | Minimum −15 dB | Minimum −15 dB |
| Power ratio | 1:3 | 1:2.7 |
| Isolation | Average −20 dB | Average −20 dB |

That is, a value obtained by measuring performance of the fabricated power divider is very similar to a value predicted through the simulation. The measured insertion loss and return loss are −0.7 dB and −1.5 dB respectively, and a power ratio between the output ports (port 2 and port 3) is 1:2.7. In addition, since isolation between output ports is −20 dB, a power divider to which a PBG CPW in accordance with the present invention has been applied, has a high characteristic impedance, can be easily fabricated, and can endure high input power. In addition, a power divider to which a PBG CPW in accordance with the present invention has been applied can endure high power.

In addition, a PBG CPW transmission line in accordance with the present invention can be used as a transmission line in an antenna and a filter requiring a high characteristic impedance. And, since the PBG CPW transmission line in accordance with the present invention can increase a characteristic impedance by increasing an inductance component in a limited structure, it can be applied to a phase shifter to delay a phase of a signal.

As so far described, a transmission line having a photonic band gap (PBG) coplanar waveguide (CPW) structure is advantageous in that four rectangular grooves which are symmetric to each other are placed on a ground conductive layer, and a width and a position of slots connected to the rectangular grooves are changed, thereby increasing a characteristic impedance of the transmission line and a width of a signal line.

In addition, a transmission line having a photonic band gap (PBG) coplanar waveguide (CPW) structure can be easily fabricated and can endure even high power since a characteristic impedance can be increased even though a width of a signal line is increased.

In addition, a power divider to which a transmission line having a photonic band gap (PBG) coplanar waveguide (CPW) structure is applied can prevent a line from being broken due to a use of high power and can be easily fabricated, since a transmission line having a high characteristic impedance and a wide width is applied to the power divider.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A power divider comprising:

a substrate;

a first conductive layer formed on a part of the substrate;

a resistance layer formed on a part of the substrate;

a seed layer formed on a part of the resistance layer and on both side surfaces of the resistance layer;

a second conductive layer formed on the seed layer;

rectangular grooves formed on the first conductive layer; and slots connected to the rectangular grooves, wherein, the first conductive layer is formed close to the second conductive layer, and the slots are symmetric to each other and placed close to each other.

2. The power divider of claim 1, the slots are formed at edges of the rectangular grooves respectively.

3. The power divider of claim 1, wherein four slots and four rectangular grooves are formed.

4. The power divider of claim 1, wherein a distance between slots formed at each rectangular groove and a width of each slot are determined by a characteristic impedance value of the transmission line, regardless of a width of the second conductive layer.

5. A method for fabricating a power divider comprising:

forming a resistance layer on a part of a substrate having a first conductive layer;

forming a seed layer on a part of the resistant layer and on both side surfaces of the resistance layer;

forming a second conductive layer on the seed layer;

forming rectangular grooves on the first conductive layer; and forming a slot at the rectangular groove, wherein the first conductive layer is formed close to the second conductive layer, and the slots are symmetric to each other and placed close to each other.

6. The method of claim 5, wherein the slots are formed at edges of the rectangular grooves respectively.

7. The method of claim 5, wherein four slots and four rectangular grooves are formed.

8. The method of claim 5, wherein a distance between slots formed at each rectangular groove and a width of each slot are determined by a characteristic impedance value of the transmission line, regardless of a width of the second conductive layer.

* * * * *